US009352245B2

(12) United States Patent
Zealer

(10) Patent No.: US 9,352,245 B2
(45) Date of Patent: May 31, 2016

(54) CONNECTION APPARATUS FOR A LEVITATING SYSTEM

(71) Applicant: Carl Zealer, Canal Winchester, OH (US)

(72) Inventor: Carl Zealer, Canal Winchester, OH (US)

( * ) Notice: Subject to any disclaimer, the term of this patent is extended or adjusted under 35 U.S.C. 154(b) by 0 days.

(21) Appl. No.: 14/257,494

(22) Filed: Apr. 21, 2014

(65) Prior Publication Data

US 2014/0228137 A1 Aug. 14, 2014

Related U.S. Application Data

(63) Continuation of application No. 13/371,983, filed on Feb. 13, 2012, now Pat. No. 8,740,715.

(60) Provisional application No. 61/441,995, filed on Feb. 11, 2011, provisional application No. 61/473,466, filed on Apr. 8, 2011.

(51) Int. Cl.
*A63J 5/02* (2006.01)
*A63J 21/00* (2006.01)

(52) U.S. Cl.
CPC ... *A63J 5/02* (2013.01); *A63J 21/00* (2013.01)

(58) Field of Classification Search
CPC ..... A63J 1/00; A63J 5/12; A63J 7/00; A63J 21/00; A63H 37/00; A63H 33/00; A63B 5/22
USPC ..... 472/68, 70, 72, 73, 75; 446/26–28
See application file for complete search history.

(56) References Cited

U.S. PATENT DOCUMENTS

| | | | | |
|---|---|---|---|---|
| 2,859,552 | A * | 11/1958 | Bornstein | 446/27 |
| 5,254,077 | A | 10/1993 | Nottingham et al. | |
| 6,113,452 | A * | 9/2000 | McGowan | A63B 5/22 446/146 |
| 6,220,917 | B1 * | 4/2001 | Nelson | A63H 33/00 273/115 |
| 6,443,848 | B1 | 9/2002 | Sisofo | |
| 6,776,679 | B1 * | 8/2004 | Menow | A63B 5/22 446/236 |
| 2009/0176433 | A1 | 7/2009 | Forti | |
| 2011/0177871 | A1 | 7/2011 | Mesika | |

OTHER PUBLICATIONS

PCT/US2012/024877 Written Opinion of the International Searching Authority dated May 21, 2012.
PCT/US2012/024877 International Search Report dated dated May 21, 2012.

(Continued)

*Primary Examiner* — Kien Nguyen
(74) *Attorney, Agent, or Firm* — Kegler Brown Hill & Ritter Co., L.P.A.; James Pingor

(57) ABSTRACT

A system and method of performing a mystical card flying illusion or 'trick' is provided. In accordance with the innovation, an invisible (or near invisible) levitation means (e.g., string, thread, etc.) can be used to create the illusion of a levitating and/or spinning playing card. The levitation means can be pre-attached or fixedly attached to an ear piece that is configured to fit over and behind a user's ear. Further, an illumination system can be provided in connection with the levitation illusion system. Moreover, spinning aides can be provided to assist a user in rotating or spinning a levitation item (e.g., card).

13 Claims, 11 Drawing Sheets

(56) References Cited

OTHER PUBLICATIONS

Jscherrer7. Mystify.wmV.youtube.com; Jan. 27, 2011; online, retrieved on May 7, 2012; Retrieved from the Internet: <URL: http://www.youtube.com/watch?v=hBGnskAdfzY>.

Baker, Lisa C.; 'Hummer Card Magic Tricks Revealed'; eHow.com; Jun. 3, 2010; online, retrieved on May 7, 2012; Retrieved from the Internet: <URL:http://web.archive.org/web/20100603202129/http://www.ehow.com/way__5492508hummer-card-magic-tricks-revealed.html >.

* cited by examiner

CONNECTION APPARATUS FOR A LEVITATING SYSTEM

CROSS-REFERENCE TO RELATED APPLICATIONS

This application is a continuation of and claims priority to U.S. Non-Provisional patent application, Ser. No. 13/371,983 entitled "CONNECTION AND ILLUMINATION APPARATUS FOR A LEVITATION SYSTEM", filed on Feb. 13, 2012, which claims the benefit of U.S. Provisional Patent Application, Ser. No. 61/441,995 entitled "LEVITATING CARD SYSTEM AND METHOD THEREOF", filed on Feb. 11, 2011 and U.S. Provisional Patent Application, Ser. No. 61/473,466 entitled "LEVITATION ILLUSION ILLUMINATION SYSTEM", filed on Apr. 8, 2011. The entirety of the above-noted application(s) are incorporated by reference herein.

ORIGIN

The disclosure herein is related to illusions and more specifically, to a string apparatus attached to an object to give the illusion that the object levitates.

BACKGROUND

Magic is a performing art that entertains an audience by creating illusions of seemingly impossible or supernatural feats, often using purely natural means. These feats are often called magic tricks, effects, or illusions. One who performs such illusions is most often referred to as a magician or illusionist.

Card magic is a specific type of magic that usually deals with creating magical effects using a deck of playing cards. Traditionally, card magic was commonplace in magical performances, especially in close up magic, such as parlor or street magic. Over the years, playing cards became popular with magicians because cards are inexpensive, versatile, and easily available. Although magicians have created and presented myriad of illusions with cards, sometimes referred to 'card tricks', most of these illusions are generally considered to be built upon similar principles and techniques.

Card magic, in one form or another, likely dates from the time playing cards became commonly known, towards the second half of the fourteenth century, but its history in this period is largely undocumented. Due to versatility as a prop, card magic has become very popular amongst modern magicians. While many card tricks use a complete deck of playing cards, oftentimes, individual cards are used to create mystifying illusions such as a spinning and seemingly floating cards.

BRIEF DESCRIPTION

This brief description is provided to introduce a selection of concepts in a simplified form that are described below in the detailed description. This brief description is not intended to be an extensive overview of the claimed subject matter, identify key factors or essential features of the claimed subject matter, nor is it intended to be used to limit the scope of the claimed subject matter.

The disclosure, in one aspect thereof, includes a system and method of performing a mystical card flying illusion or 'trick.' In accordance with one or more aspects, an invisible (or near invisible) levitation means (e.g., string, thread, etc.) may be employed to create the illusion of levitating and/or spinning a playing card. The levitation means may be pre-attached or fixedly attached to an ear piece that is configured to fit over and behind a user's ear.

In one or more embodiments, a system that facilitates an illusion of levitating an item includes a levitation item, a connection means attached to a user, and a levitation means providing a connection between the levitation item and the connection means, whereby the levitation means provides a means to facilitate the illusion of floating the levitation item based on actions of the user.

In one or more embodiments, the levitation means may be pre-attached or otherwise fixedly attached to eyeglasses, headwear, hair accessories, or the like so as to create an illusion of a levitating card.

In one or more embodiments, an illumination system may be applied to a levitation item thereby enhancing the visual experience. The illumination system may include two members (e.g., top and bottom) that may attach around a levitation item, such as a playing card. The system may be equipped with a set (or more) of LEDs or other illumination devices. A power source may be provided and, in one aspect, positioned beneath the playing card. A levitation means may be attached to an attachment pad upon the top of the card. Further, optional spinning aides may be affixed so as to assist in initiating rotation of the card.

The following description and annexed drawings set forth certain illustrative aspects and implementations. These are indicative of but a few of the various ways in which one or more aspects may be employed. Other aspects, advantages, or novel features of the disclosure will become apparent from the following detailed description when considered in conjunction with the annexed drawings.

BRIEF DESCRIPTION OF THE DRAWINGS

Aspects of the disclosure are understood from the following detailed description when read with the accompanying drawings. Elements, structures, etc. of the drawings may not necessarily be drawn to scale. Accordingly, the dimensions of the same may be arbitrarily increased or reduced for clarity of discussion, for example.

DETAILED DESCRIPTION

Figure 1:
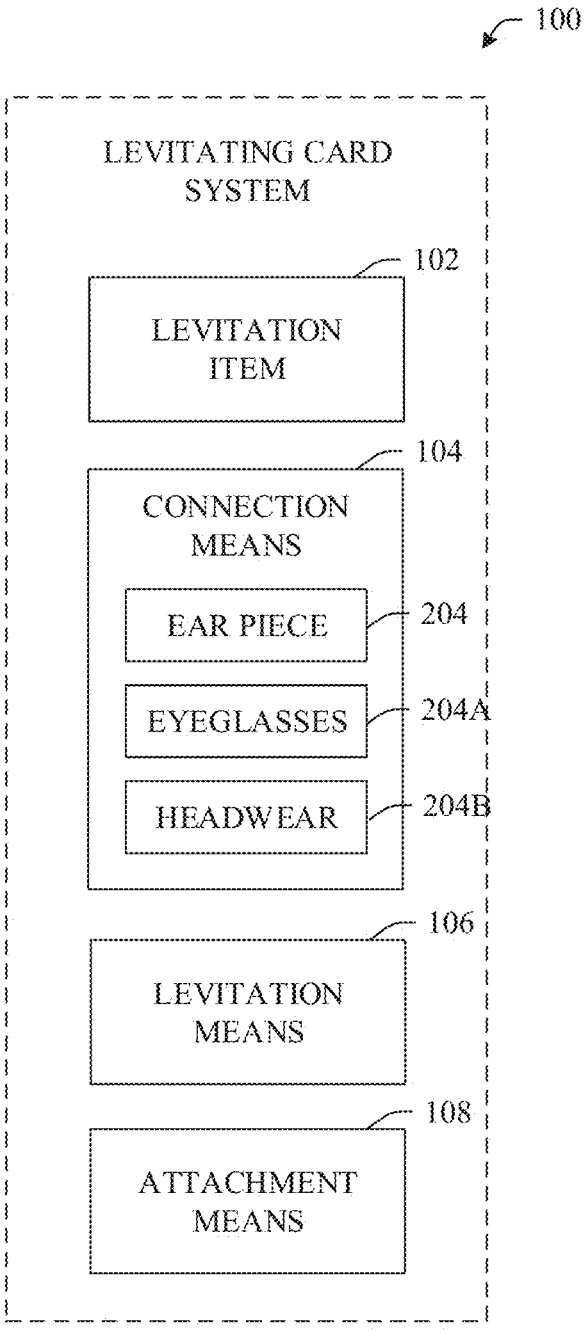
FIG. 1 illustrates an example block diagram of a levitating system, according to one or more embodiments.

Embodiments or examples, illustrated in the drawings are disclosed below using specific language. It will nevertheless be understood that the embodiments or examples are not intended to be limiting. Any alterations and modifications in the disclosed embodiments, and any further applications of the principles disclosed in this document are contemplated as would normally occur to one of ordinary skill in the pertinent art.

Referring initially to the drawings, FIG. 1 illustrates an example block diagram of a levitating system 100 in accordance with one or more aspects. As shown, the levitating system 100 may include a levitation item 102, a connection means 104, a levitation means 106, and an attachment means 108. In alternative embodiments, the levitating system 100 may include illumination devices and/or spinning aides, which assist the levitation item 102 to spin, as will be described further below.

Referring to FIG. 1 and FIG. 2A-2D, it will be appreciated that the levitation item 102 may be any suitable object, such as but not limited to a playing card, a credit card, a dollar bill, a business card, a coin, a ball, a pencil, etc. The connection means 104 may be any suitable object that provides a means to connect the levitating item 102 to a user performing the illusion, such as but not limited to an ear piece, eyeglasses 204A, headwear (e.g. hat, visor, etc.) 204B, hair accessories, etc. The levitation means 106 may be any suitable means to connect the levitating item 102 with the connection means 104, such as but not limited to thread, string, fishing line, etc. It will be appreciated that the levitation means 106 may be any color and/or transparent so as to appear invisible (or nearly invisible) such that a spectator may not notice it upon viewing the illusion. The attachment means 108 may be any suitable pliable material to attach the levitation means 106 to the levitating item 102 and/or to the connection means 104, such as but not limited to wax, putty, sticky tack, etc. In the example embodiment illustrated in FIG. 2A-2D, the levitation item 102 is a playing card 202, the connection means 104 is an over the ear type ear piece 204, the levitation means 106 is a piece of thread 206, and the attachment means 108 is wax 208. It will be appreciated that the ear piece 204 may be the type that fits into the ear. In addition, it will be appreciated that the ear piece 204 described herein may be made of most any suitably rigid material including, but not limited to, plastic, rubber, metal, wood or the like and may be shaped in a manner such that it may be easily fit over the user's ear and equipped with an end cap to enhance comfort. It will be appreciated that while in one embodiment, described below, the thread 206 is pre-attached to the ear piece 204. In other embodiments, however, the thread 206 may be replaced as desired. For example, to enhance the illusion of levitation, it might be beneficial to conceal the thread 206 by, for example, replacing the thread 206 with thread consistent with the user's shirt color. Further, in yet other embodiments, it will be appreciated that thread color may correspond to a user's skill level. For example, a white string may be a novice string while a darker color (e.g., black) may correspond to a more advanced skill level. Still further, threads having different thicknesses may be employed with alternative aspects as appropriate or desired. Thus, the example embodiment illustrated in FIGS. 2A-2D and described herein is for illustrative purposes only and is not intended to limit the scope of the disclosure.

Figure 2A:
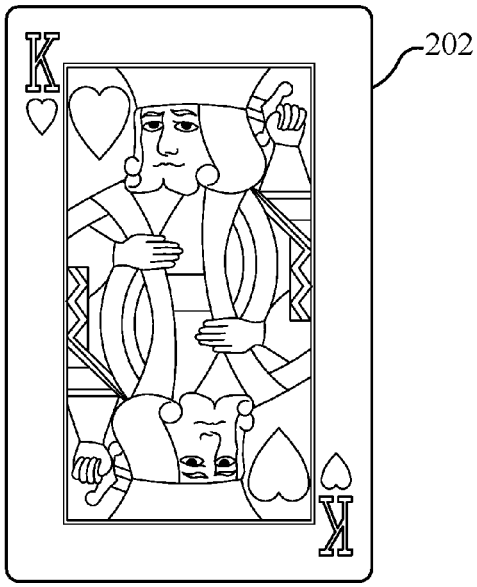
FIGS. 2A-2D illustrate an example levitating card system, according to one or more embodiments.
Figure 2C:
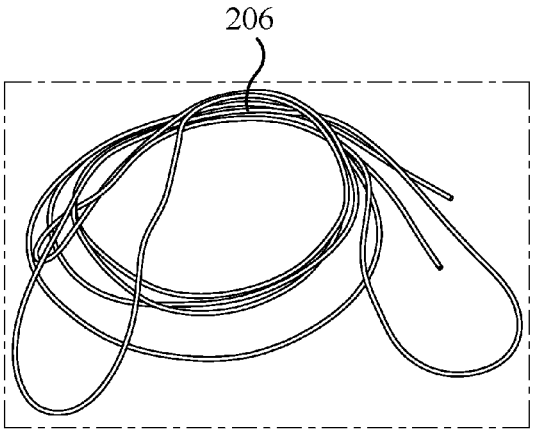
Figure 2B:
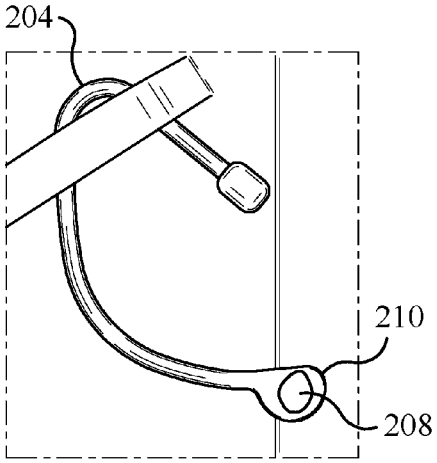
Figure 2D:
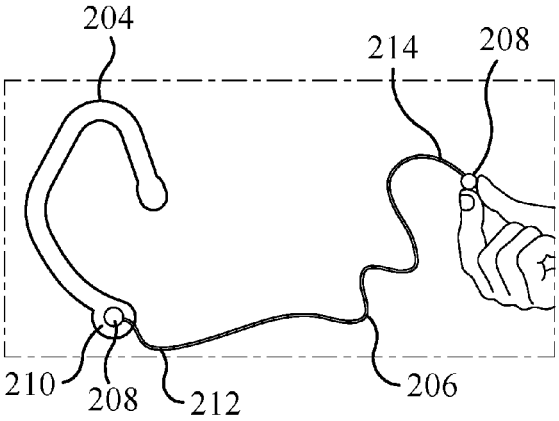
Figure 3:
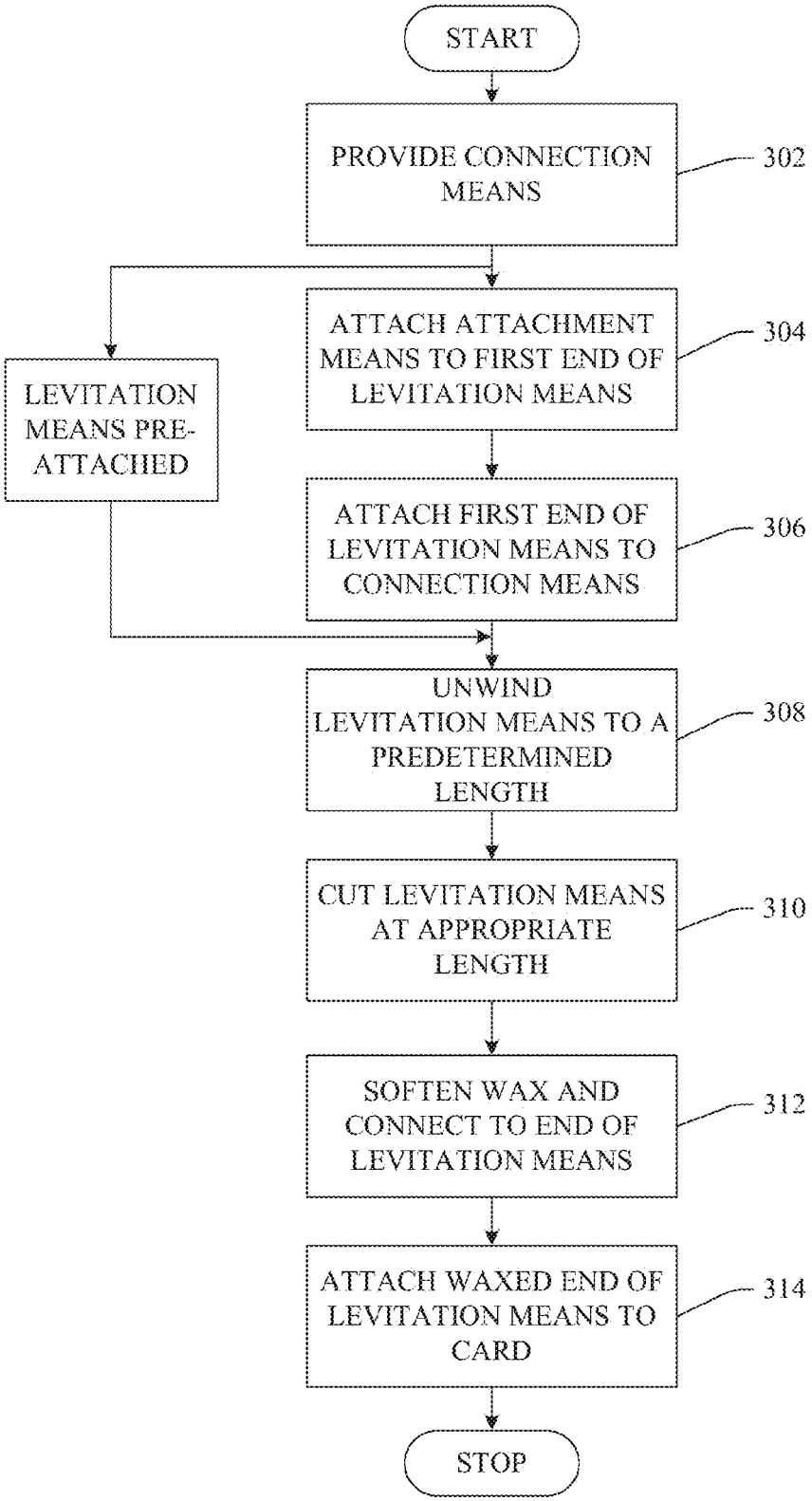
FIG. 3 illustrates an example flow chart of procedures that facilitate system preparation, according to one or more embodiments.

Referring to FIG. 3 and with reference to FIGS. 2A-2D, FIG. 3 illustrates a methodology of configuring the levitation system 100 in accordance with one or more aspects. While, for purposes of simplicity of explanation, the one or more methodologies shown herein, e.g., in the form of a flow chart, are shown and described as a series of acts, it will be appreciated that the disclosure is not limited by the order of acts, as some acts may, in accordance with one or more aspects, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the one or more aspects.

At 302, the connection means 104 (ear piece 204) is provided with either the levitation means 106 (thread 206) pre-attached with the attachment means 108 (wax 208), as shown in FIG. 2B, or not attached. If the attachment means 108 is not attached to the connection means 104, then at 304, a small amount of the attachment means 108 is softened and attached to a first end 212 of the levitation means 106. The amount of attachment means 108 should be small enough to remain concealed to enhance the illusion. At 306, the first 212 end of the levitation means 106 is attached to a bottom 210 of the connection means 104 (ear piece 204) by pressing the attachment means 108 against the bottom 210 of the connection means 104. If the attachment means 108 is attached to the connection means 104, then 304 and 306 are bypassed and the method proceeds to 308. At 308, the levitation means 106 may be unwound or otherwise extended to a predetermined length. At 310, once the appropriate length of the levitation means 106 is unwound the levitation means 106 is then cut. At 312, a small amount of the attachment means 108 is again softened and attached to a second (cut) end 214 of the levitation means 106. At 314, the second end 214 of the levitation means 106 is attached to the levitating item 102 by pressing the attachment means 108 against the levitating item 102. It will be appreciated that in order to enhance the illusion of levitation, the levitating item 102 should be balanced as much as possible. For example, in the embodiment disclosed herein, the wax 208 along with the second end 214 of the thread 206 should be placed as close as possible to the middle of the card 202, such that the card 202 hangs flat and straight, like a table.

Figure 4:
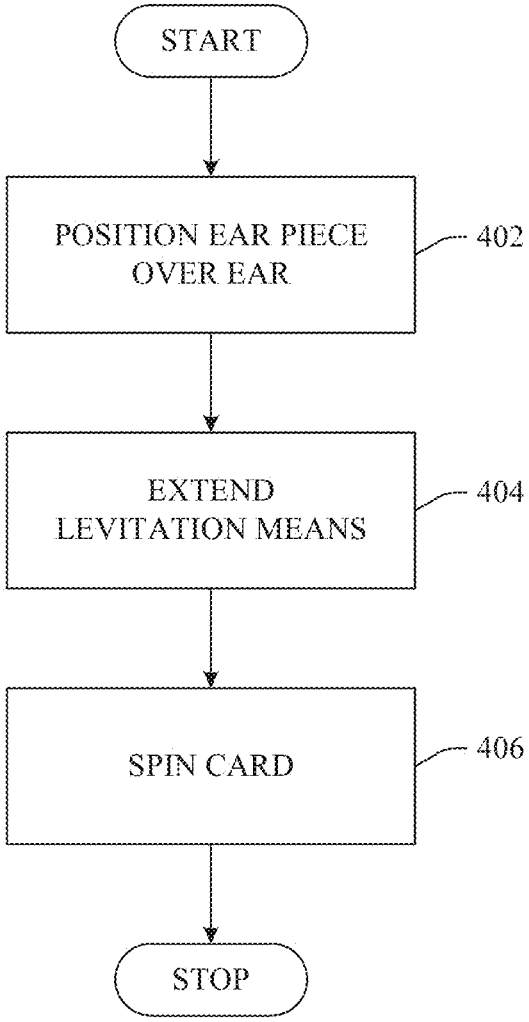
FIG. 4 illustrates an example flow chart of procedures that facilitate card levitation, according to one or more embodiments.

FIG. 4 is an example flow chart illustrating acts of levitating the levitation item 102 in accordance with one or more aspects. At 402, the connection means 104 is attached to the user performing the illusion. In the example embodiment disclosed herein, the ear piece 204 is positioned over the user's ear. At 404, the levitation means 106 (thread 206) may be extended having the levitation item 102 (card 202) attached thereto. At 406, the levitation item 102 may now be spun (see FIG. 5A) to perform the illusion of a levitating item or object. Specifically, because the levitating item 102 is suspended by an invisible (or nearly invisible) levitation means 106, the levitating item 102 appears to levitate. To further enhance the illusion, the first end 212 of the levitation means 206 may be attached behind the user's ear using a small piece of adhesive (e.g., a Band-Aid, tape, etc.) as opposed to using the connection means 104.

Figure 5A:
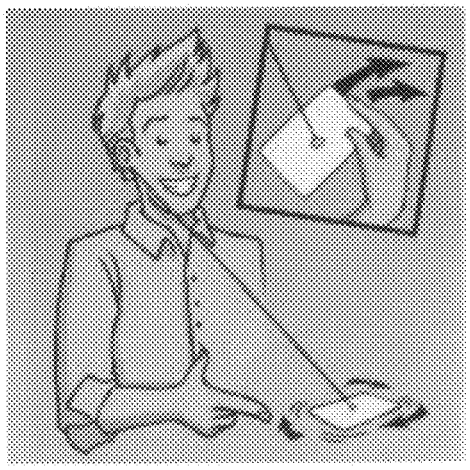
FIGS. 5A-5D illustrate example instructions for use of the levitating card system, according to one or more embodiments.
Figure 5B:
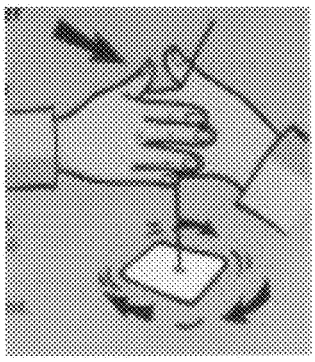
Figure 5C:
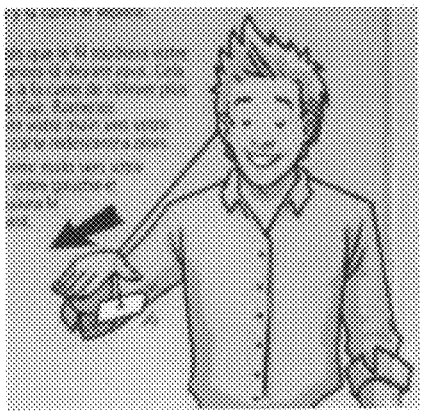
Figure 5D:
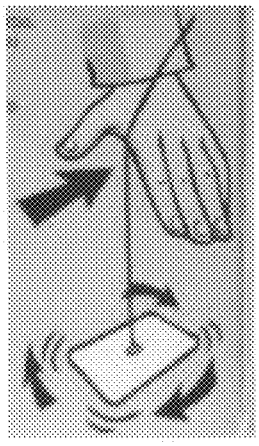

FIGS. 5A-5D are example illustrations of tips for practicing the illusion of levitation in accordance with one or more aspects. For example, FIG. 5A illustrates the proper technique for initially spinning the levitating item 102. FIG. 5B illustrates a technique for guiding or floating the levitating item 102 from hand to hand. FIGS. 5C and 5D illustrate the proper techniques of moving the levitating items 102 in an up and down direction. Specifically, once the levitating item 102 is spinning, the user contacts the levitation means 106 between their thumb and index finger and move their hand away from themselves (FIG. 5C) to raise the levitating item 102 and toward themselves (FIG. 5D) to lower the levitating item 102.

FIGS. 6-11 are illustrations of alternate embodiments of the levitation system 100 described above. Specifically, FIG. 6-11 are examples of illumination devices and weighted objects to enhance the illusion.

Figure 6:
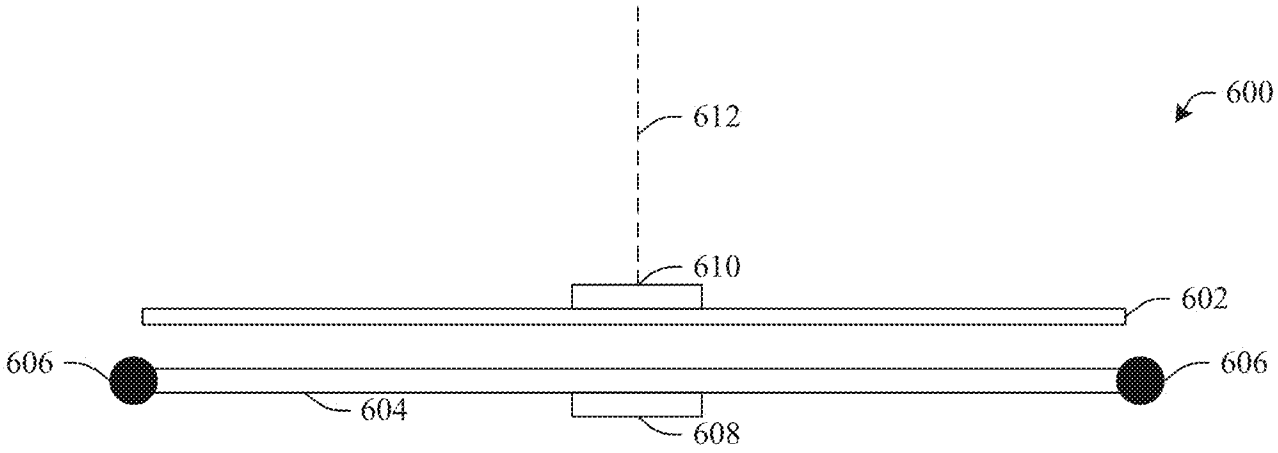
FIG. 6 illustrates an example illumination system, according to one or more embodiments.

Referring to FIG. 6, an example illumination system 600 is shown in accordance with one or more aspects. Generally, in an aspect, the system 600 may include a first (upper) member 602, a second (lower) member 604, and multiple illumination devices 606 fixedly attached to opposite ends of the first member 602 and/or the second member 604. It will be appreciated that the illumination devices 606 may be attached at any location on either the first and/or second member 602, 604, as long as the illumination system 600 remains balanced. In the embodiment shown in FIG. 6, the illumination devices 606 are attached at each end of the second member 604. It will be appreciated that the illumination devices 606 may be any suitable illuminating device, such as but not limited to, LED's, or other illuminating devices requiring a power source, illuminating devices not requiring a power source, such as but not limited to, glow in the dark devices, illuminating devices that illuminate upon motion (e.g., spinning), etc.

While multiple members are illustrated in FIG. 6, it will be appreciated that the configuration may be modified into a single member having a slot sizably configured to accept the levitation item 102 described above. In one or more embodiments for FIG. 6, a fastening means, such as but not limited to magnets, clips, adhesives, etc. may be employed to affix the two members about the levitation item or card.

For illuminating devices requiring power, a power source compartment housing a power source 608, such as but not limited to a battery, may be provided and disposed about a centerline 612 between the illuminating devices 606 which, in this embodiment, are disposed at each end of the second member 604. It will be appreciated that the power source 608 may be centered so as to not affect the equilibrium of the spinning levitation item 102. Opposite the power source 608 and positioned about the centerline 612 of the first member 602 is an attachment pad 610. In operation, the attachment pad 610 may be used as a position to connect or place the attachment means 108 (e.g. wax) and ultimately the levitation means 106 (e.g. thread 106). In other aspects, the attachment pad 610 may include a means by which the levitation means 106 may be threaded or otherwise attached. Still further, the levitation means 106 may be molded or pre-attached to the attachment pad 610. These and other aspects are to be included within the scope of this disclosure and claims appended hereto.

So as to minimize and/or hide the appearance of the first and second members 602, 604, each of the first and second members 602, 604 may be manufactured of a clear, transparent, or semi-transparent material so as to minimize noticeability. In other words, because the first and second members 602, 604 may be transparent or clear, the ability to see them around the card is minimized, similar to that of the levitation means 106.

Figure 7:
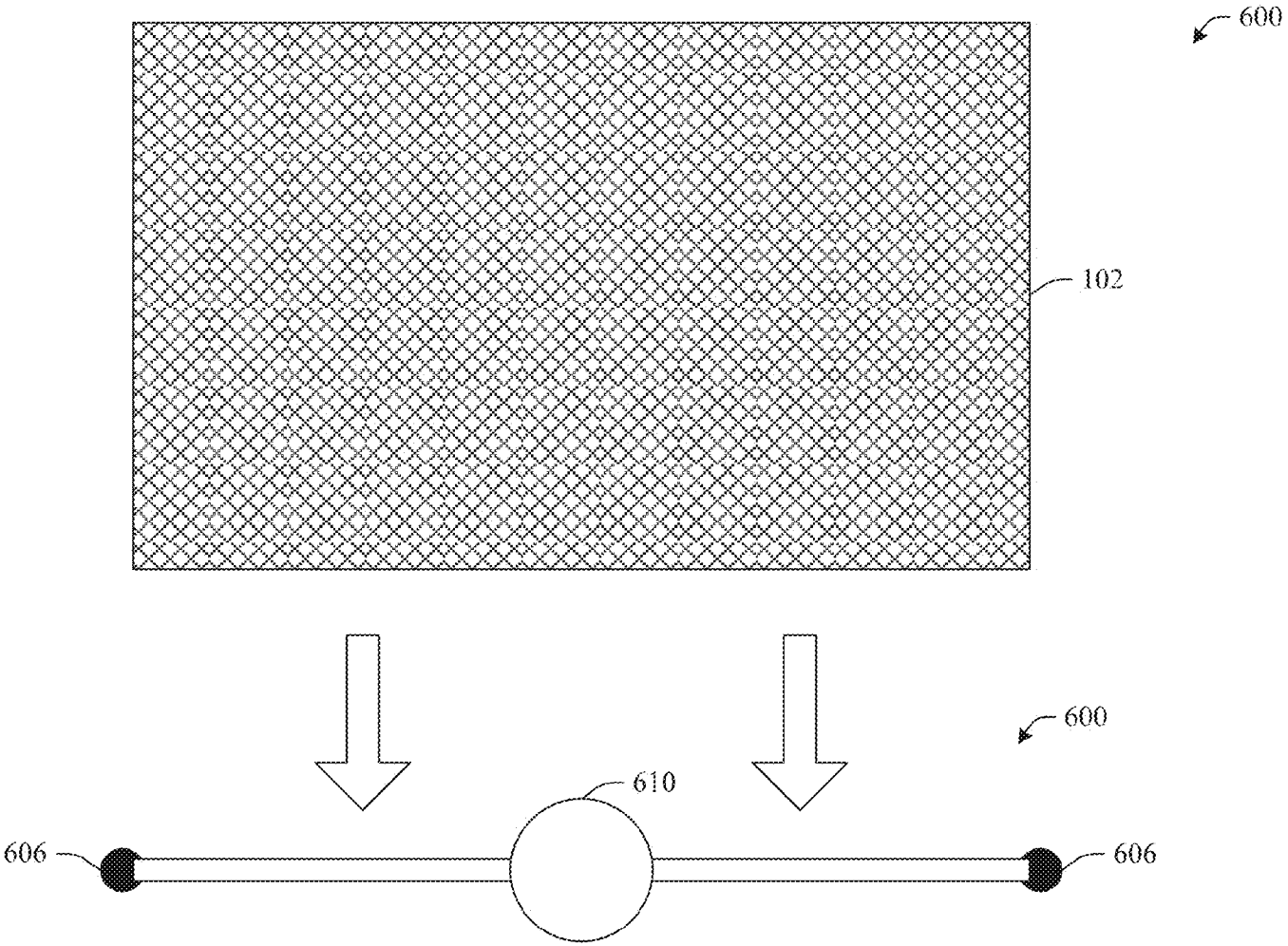
FIG. 7 illustrates insertion of a playing card into an illumination system, according to one or more embodiments.

Referring now to FIG. 7, a diagram of a levitating system 700 incorporating the levitation item 102 into the illumination system 600 of FIG. 6 is shown in accordance with one or more aspects. As shown, the levitation item 102, such as a playing card, may be slidably inserted into the illumination system 600 illustrated in FIG. 6. Once the levitation item 102 is inserted, the levitation illusion may be commenced whereby the levitation means 106 may be attached to the attachment pad 610 of the illumination system 600. Thereafter, the illumination devices 606 may be illuminated and the levitation item 102 spun. In an alternative embodiment, a switching means may be used to toggle the illumination devices 606 on and off. As mentioned above, in another embodiment, the spinning effect (motion) of the levitation item 102 may effect turning the illumination devices 606 on and off as appropriate. In still yet another embodiment, the illumination devices 606 may be synchronized to music from an electronic device, such as but not limited to an MP3 player, to turn on an off and keep time to the music.

Figure 8:
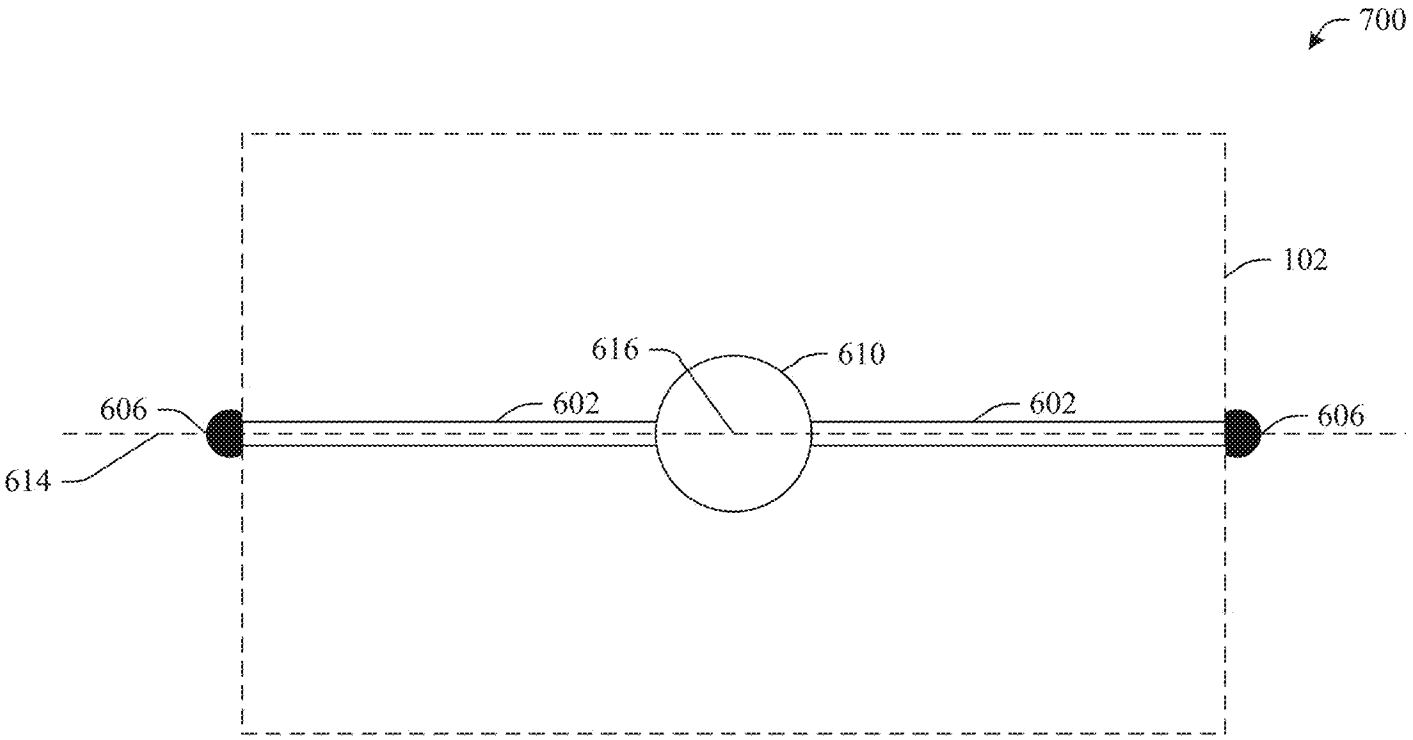
FIG. 8 illustrates a top view of an illumination system, according to one or more embodiments.

Turning now to FIG. 8, a top view of the levitating system 700 is shown. As illustrated, the first member 602 and hence, the second member 604, which is hidden are positioned along a centerline 614 of the levitation item 102. Further, both the first and second members 602, 604 traverse the length of the levitation item 102. As a result, the attachment means 610 is positioned at a center 616 of the levitation item 102 so as to maintain balance and not to obscure, obstruct or affect the spinning motion of the card. It will be appreciated, however, that the first and second members 602, 604 may traverse the levitation item 102 in any direction or orientation, such as but not limited to, a width direction, a diagonal direction, etc., as long as not to affect the equilibrium of the levitation item 102.

Figure 9:
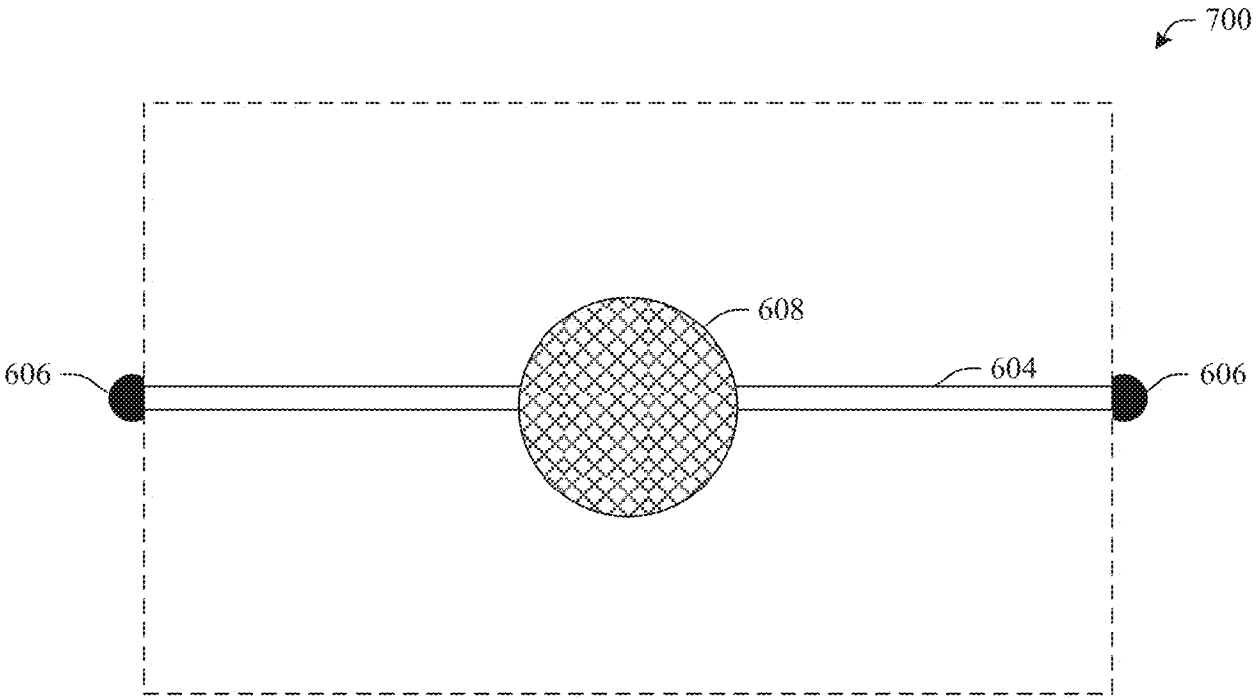
FIG. 9 illustrates a bottom view of an illumination system, according to one or more embodiments.

FIG. 9 is an illustration of a bottom view of the illumination system 700 illustrating the location of the power source 608 in accordance with one or more aspects. The power source 608 may be electrically coupled to the illumination devices 606 via the second member 604. Thus, upon engagement, the illumination devices 606 may be illuminated, for example while spinning.

Figure 10:
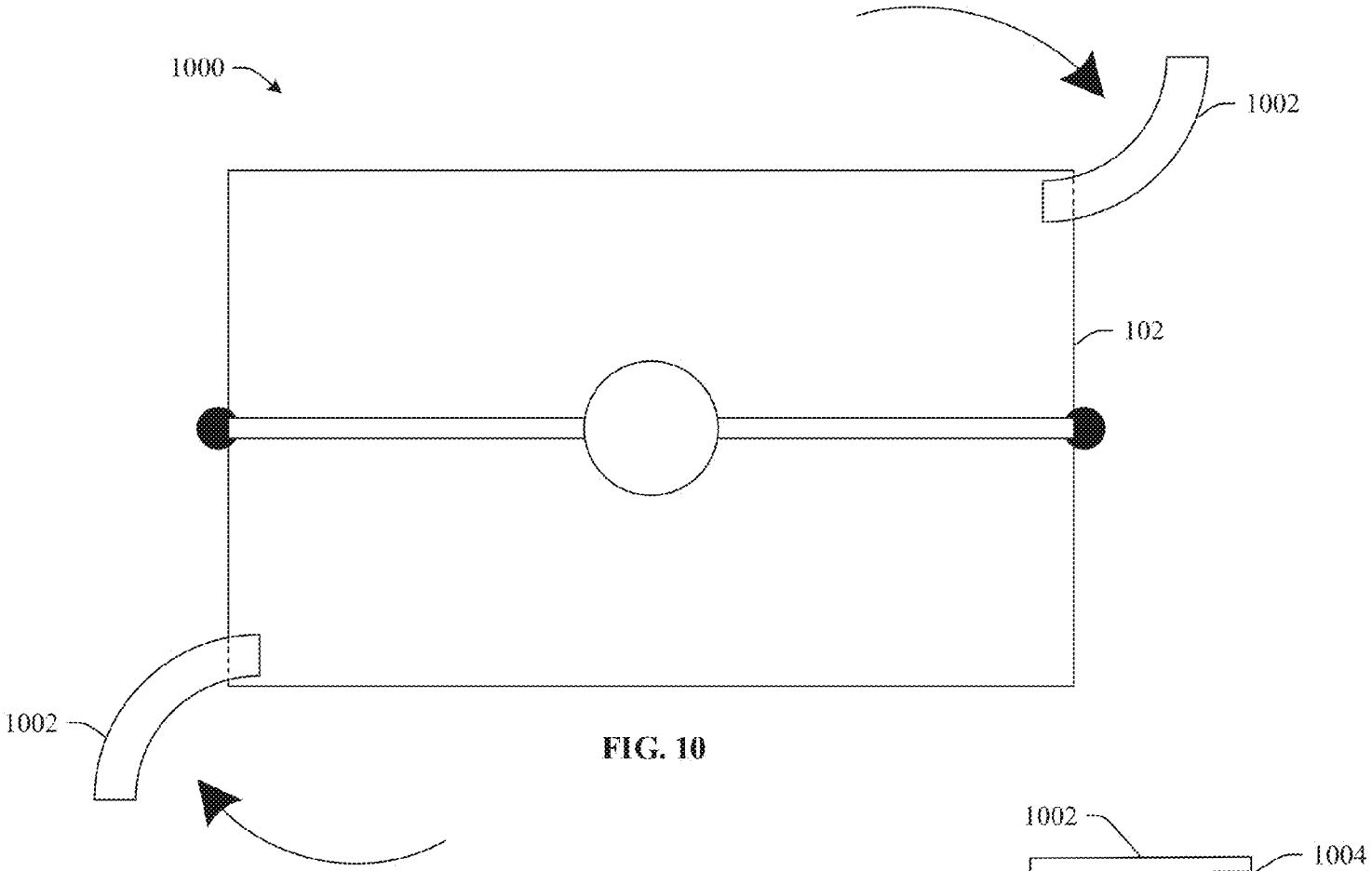
FIG. 10 illustrates an embodiment having spinning aides, according to one or more embodiments.
Figure 10A:
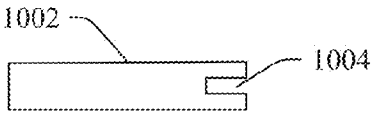
FIG. 10A illustrates a side view of the spinning aide showing a slot defined therein, according to one or more embodiments.

FIGS. 10 and 10A illustrate yet another aspect 1000 that employs spinning aides 1002 which assist in spinning the levitation item 102 (e.g., card). As shown, the spinning aides 1002 may be positioned into or about the corners of the levitation item 102, such that the spinning aides 1002 are weighted to balance the levitation item 102. The spinning aides 1002 are configured (e.g., arched) so as to conform and assist in the spinning motion of the levitation item 102. In one aspect, the spinning aides 1002 may include a slot 1004 or channel into which the levitation item 102 may slidably attach. In another aspect, the spinning aides 1002 may be attached to the levitation item 102 via adhesives, clips, etc. While the spinning aides 1002 are shown in conjunction with the illumination system 600, it will be appreciated that the spinning aides 1002 may be used separate from the illumination system 600 in an alternative embodiment.

Figure 11:
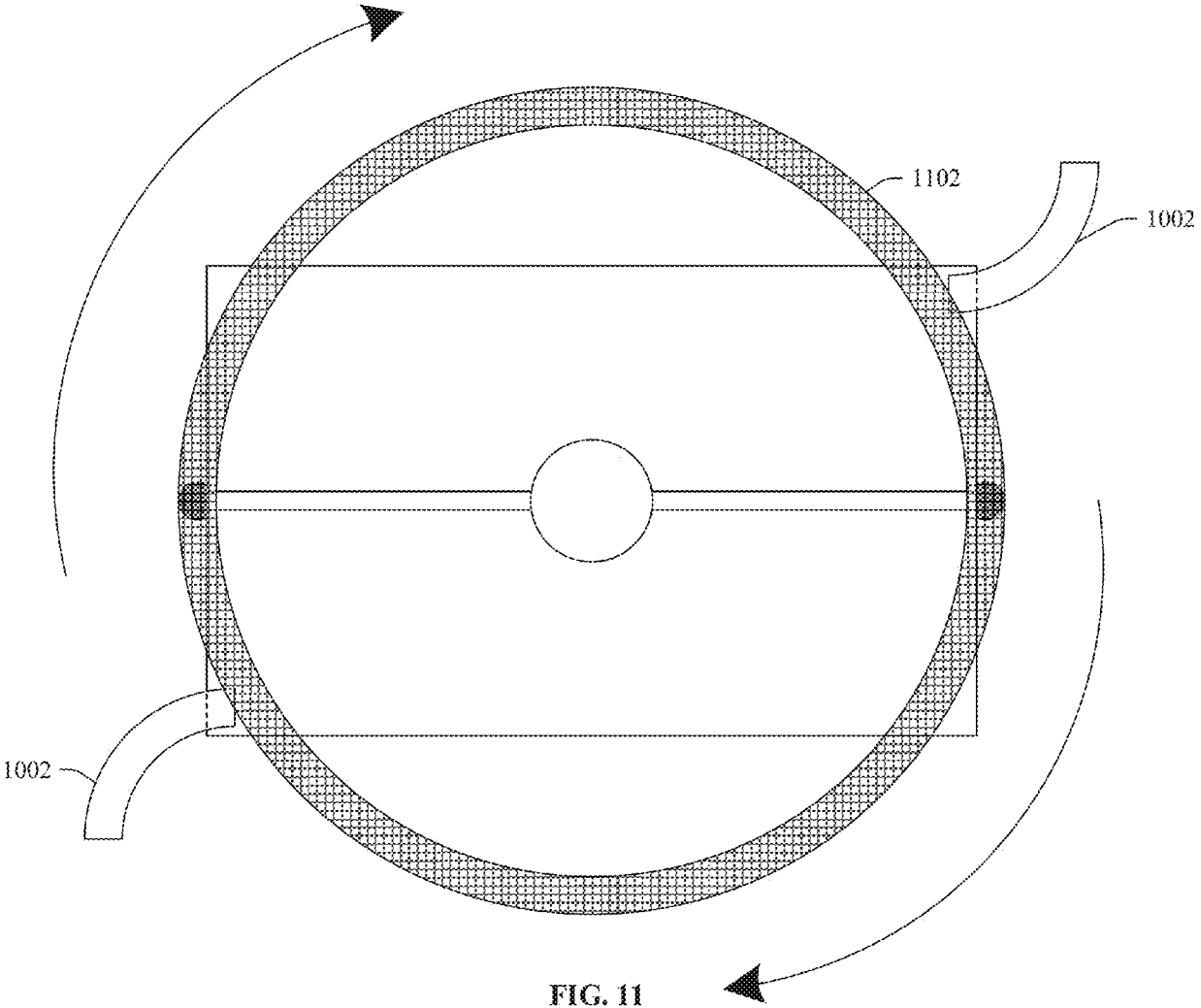
FIG. 11 illustrates an embodiment in motion, according to one or more embodiments.

During operation, a user spins the levitation item 102 by exerting force upon one of the spinning aides 1002, as indicated by the arrow. If the spinning aides 1002 are used in conjunction with the illumination system, an illumination circle 1102 may be seen as shown in FIG. 11. It will be appreciated that the motion of the illumination devices 606 in a circular pattern may appear as an illuminated circle about the center of the levitation item 102.

Although the subject matter has been described in language specific to structural features or methodological acts, it is to be understood that the subject matter of the appended claims is not necessarily limited to the specific features or acts described above. Rather, the specific features and acts described above are disclosed as example embodiments.

Various operations of embodiments are provided herein. The order in which one or more or all of the operations are described should not be construed as to imply that these operations are necessarily order dependent. Alternative ordering will be appreciated based on this description. Further, not all operations may necessarily be present in each embodiment provided herein.

As used in this application, "or" is intended to mean an inclusive "or" rather than an exclusive "or". Further, an inclusive "or" may include any combination thereof (e.g., A, B, or any combination thereof). In addition, "a" and "an" as used in this application are generally construed to mean "one or more" unless specified otherwise or clear from context to be directed to a singular form. Additionally, at least one of A and B and/or the like generally means A or B or both A and B. Further, to the extent that "includes", "having", "has", "with", or variants thereof are used in either the detailed description or the claims, such terms are intended to be inclusive in a manner similar to the term "comprising".

Further, unless specified otherwise, "first", "second", or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel. Additionally, "comprising", "comprises", "including", "includes", or the like generally means comprising or including, but not limited to.

Although the disclosure has been shown and described with respect to one or more implementations, equivalent alterations and modifications will occur based on a reading and understanding of this specification and the annexed drawings. The disclosure includes all such modifications and alterations and is limited only by the scope of the following claims.

What is claimed is:

1. A system for creating a levitating illusion, comprising:
a pair of eyeglasses;
a levitation item connected to the pair of eyeglasses; and
a pair of weighted spinning aides attached to opposite sides of the levitation item, wherein the pair of spinning aides in balancing the levitation item to thereby assist in a spinning of the levitation item via the pair of eyeglasses.

2. The system of claim 1, wherein the levitation item is a playing card, a credit card, a coin, or a ball.

3. The system of claim 1 further comprising a levitation means connecting the pair of eyeglasses and the levitation item and being comprised of a thread, a string, or a fishing line, wherein the levitation means facilitates a levitating illusion by connecting the levitation item to the pair of eyeglasses.

4. The system of claim 1, wherein the pair of spinning aides is arched.

5. The system of claim 1, wherein one or more of the plurality of spinning aides comprises a slot or a channel into which the levitation item slidably attaches.

6. The system of claim 1, comprising one or more illumination devices.

7. The system of claim 6, wherein one or more of the illumination devices glows in the dark.

8. The system of claim 6, wherein one or more of the illumination devices is an LED.

9. The system of claim 8, comprising a power source for the LED.

10. A system for creating a levitating illusion, comprising:
a pair of eyeglasses;
a levitation item;
a levitation means which connects the eyeglasses to the levitation item, wherein the levitation means facilitates a levitating illusion by connecting the levitation item with the eyeglasses; and
a plurality of spinning aides having a slot or a channel defined therein into which the levitation item slidably attaches, the plurality of spinning aides facilitating a spinning of the levitation item.

11. The system of claim 10, wherein the levitation item is a playing card, a credit card, a coin, or a ball.

12. The system of claim 10, wherein the levitation means is a thread, a string, or a fishing line.

13. The system of claim 10, wherein one or more of the plurality of spinning aides is weighted or arched.

* * * * *